United States Patent [19]

Aprato

[11] 4,235,555

[45] Nov. 25, 1980

[54] NON IMPACT DOT MATRIX PRINTER

[75] Inventor: Armando Aprato, Lugnacco, Italy

[73] Assignee: Ing. C. Olivetti & C., S.p.A., Ivrea, Italy

[21] Appl. No.: 900,487

[22] Filed: Apr. 27, 1978

[30] Foreign Application Priority Data

May 4, 1977 [IT] Italy ..... 67990 A/77

[51] Int. Cl.[3] ..... B41J 3/10; B41J 3/20

[52] U.S. Cl. ..... 400/120; 346/76 PH; 101/93.04; 400/59; 400/328

[58] Field of Search ..... 101/93.04; 219/216; 346/76 PH; 400/119, 120, 320, 320.1, 323, 328, 352, 353, 56, 57, 59

[56] References Cited

U.S. PATENT DOCUMENTS

| | | | |
|---|---|---|---|
| 3,905,462 | 9/1975 | Nowak | 400/119 |
| 3,951,247 | 4/1976 | Montanari | 400/120 |
| 3,993,181 | 11/1976 | Potma | 400/124 |
| 4,000,393 | 12/1976 | Cochran et al. | 346/76 PH X |

FOREIGN PATENT DOCUMENTS

| | | | |
|---|---|---|---|
| 294161 | 5/1971 | U.S.S.R. | 400/120 |

*Primary Examiner*—Paul T. Sewell

*Attorney, Agent, or Firm*—Schuyler, Banner, Birch, McKie & Beckett

[57] ABSTRACT

A non impact dot matrix printer of the serial-parallel or parallel type having a base member extending parallel to the line of print direction on which a plurality of adjacent printing heads is independently mounted; each head has a planar surface carrying thereon a row of dot size printing elements facing the recording medium, the rows of all the heads being aligned to form a single long row of printing elements extending parallel and equally spaced along the line of print direction; each head is fixed to an end of a resilient lamina, the other end of which is fixed to the base member, the lamina by flexing and twisting allows uniform contact of resistive elements of each head against recording medium; in the printer, the base member is reciprocated along the line of print direction by a pair of cam following rollers cooperating with a cam.

5 Claims, 3 Drawing Figures

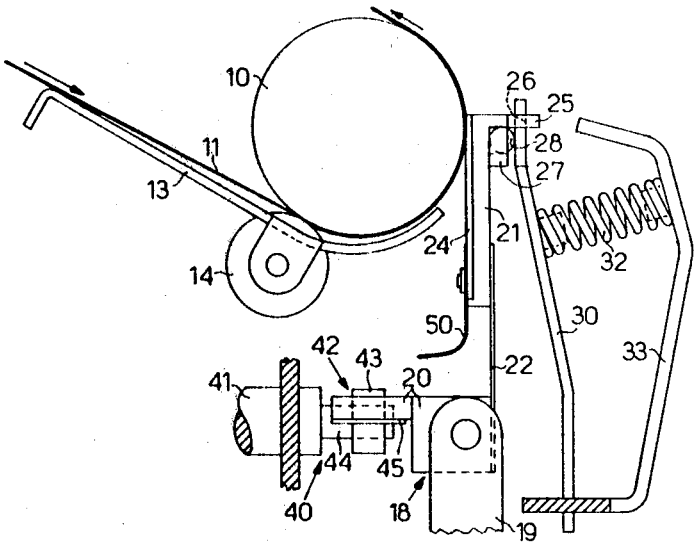
FIG. 1
FIG. 3
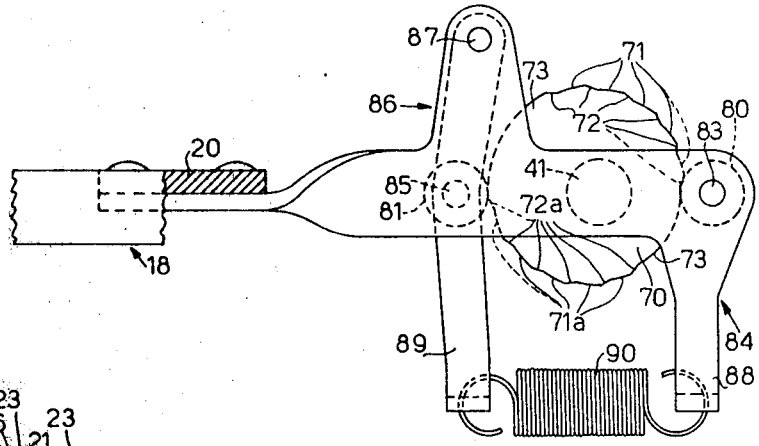
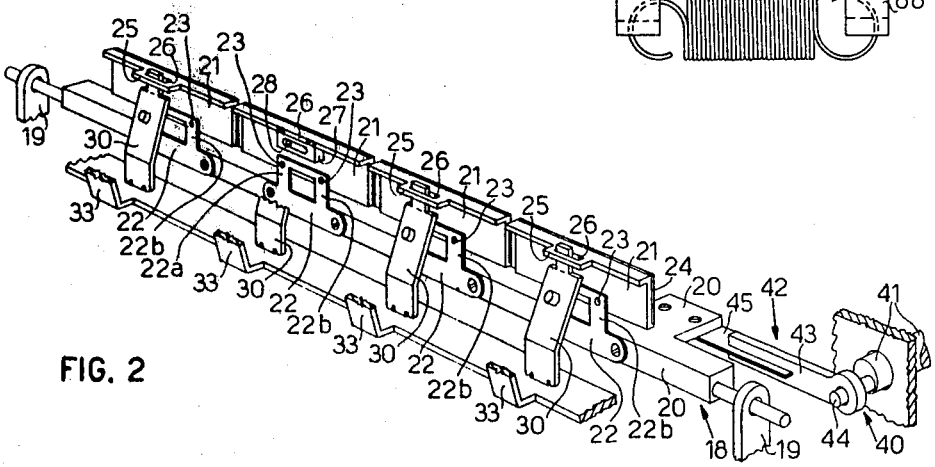
FIG. 2

NON IMPACT DOT MATRIX PRINTER

BACKGROUND OF THE INVENTION

The present invention refers to a non impact serial-parallel or parallel dot-matrix printer of the type in which a single row of regularly spaced dot-size printing elements is positioned parallel to the printing line of the recording medium.

In the serial parallel printer the row is reciprocated in the printing line direction, the recording medium is moved incrementally along a direction perpendicular to the printing line in synchronism with the movement of the row and control means are provided for selectively energizing the printing elements at a succession of positions of the row in each one of a succession of strokes thereof, such that each printing element prints all the dots of at least one character of the line during the succession of strokes.

In the parallel printer the row of printing elements is held stationary and parallel to the printing line of the recording medium while only the reconding medium is incrementally advanced perpendicularly to the printing line direction, and each printing element is selectively energized for printing all the points of a matrix column of a printable character of the line.

U.S. Pat. No. 3,951,247 discloses a serial-parallel thermal dot-matrix printer of the above mentioned type in which the row of printing elements is supported in a single thermal head including a ceramic insulating planar substrate having coated thereon a row of resitive printing elements and a pattern of conductors for selectively passing heating current through each one of the resistive elements.

The use of a single head for supporting the row of printing elements does not cause any drawback when the length of the printing line does not exceed a certain number of characters, typically 16 characters.

But when the printing line is very long, for instance 80 characters, the construction of a single planar ceramic substrate extending along almost all the length of the printing line, for supporting a row of a 80 printing elements, in the case of serial-parallel printer, or $80 \times N$ printing elements in the case of a parallel printer (where N is the number of columns of the matrix of dots according to which the characters are printed), is very critical, since it is difficult to obtain the ceramic substrate perfectly planar and little inperfections in the planarity of the substrate or in the linearity or cylindricity of the platen will cause a non uniform contact of all the printing elements against the recording medium and consequently characters printed on the same line have a non uniform darkness.

This type of drawback is not limited to thermal printers but in general to all the non impact printers using a planar head carrying thereon dot-size printing elements which should contact uniformly the recording medium for a correct printing operation. Electrosensitive or electrostatic planar heads have the same drawbacks when the row of printing elements become too long.

SUMMARY OF THE INVENTION

It is therefore an object of the present invention to provide a non impact dot matrix parallel or serial-parallel printer using a planar substrate supporting thereon dot-size selectively energizable printing elements disposed in a single row extending along the printing line of the recording medium, in which the mounting of such substrate in the printer is improved to obtain uniform contact of all the printing elements against the recording medium independently from imperfections in the linearity and cylindricity of the platen and from the length of the row.

It is another object of the invention to provide a serial parallel printer of the type set-forth above having a printing line with a great number of characters, in which the darkness of the printed characters along a same line is uniform and in which the alignment of characters belonging to different printed lines but having the same printing position along the printing line is improved.

It is a further object of the present invention to provide a thermal serial parallel dot-matrix printer, suitable for printing on a heat sensitive recording medium including a master thermal paper and an underlying thermal copy paper.

This and other objects of the present inventions will be clear by the following description made by way of example, with reference to the accompanying drawings.

BRIEF DESCRIPTION OF THE DRAWINGS

FIG. 1 is an elevation view of a thermal printer according to the invention;

FIG. 2 is a perspective view of the printer of FIG. 1;

FIG. 3 is a elevation view of an alternative embodiment of the device moving the slide of the printer of FIG. 1.

DESCRIPTION OF THE PREFERRED EMBODIMENT

The serial-parallel printer of FIGS. 1 and 2 comprises a cylindrical platen 10 on which is partially wound a sheet of thermosensitive recording paper 11.

During the printing operation the paper 11 is advanced by incremental rotations of platen 10, on which the paper is guided to wind by guiding elements 13 and roller 14.

In front of the platen 10, a slide 18 is movable parallel to the axis of platen 10, by sliding on guides 19. The slide 18 includes a base support 20 and four head supports 21 connected to the base support 20 by interposed resilient laminae 22.

Each resilient lamina 22 is substantially rectangularly shaped with a rectangular hole in the central portion in such a manner to define two parallel resilient arms **22*a* and 22*b* having the opposite ends connected to the head support 21 and to the base support 20 of the slide 18**, respectively.

On each head support 21 is fixed, by an adhesive, a planar thermal head 24 of the type disclosed in U.S. Pat. No. 3,951,247 and having a single row of twenty resistive printing elements coated on a planar ceramic substrate facing the paper 11.

The head-supports 21 are mounted on the base support 20 adjacent each other in such a manner that the rows of resistive elements of the four heads are aligned to define a single row of eighty equally spaced resistive elements and extending parallel and along the entire line of print of the paper 11.

Therefore the positioning and fixing of the head-supports 21 in the base member 21 must be conducted with high precision, either for the mounting of the resilient laminae 22 on the base member 20, or for the mounting of the head supports 21 on the upper ends of the laminae 22.

Such precision can be obtained during assembly by using well know optical sights and comparators.

According to an object of the present invention, in order to allow easy replacement of a head support 21 carrying a worn thermal head without altering the correct positioning of such support and therefore without reusing the above mentioned optical system, the head supports 21 are fixed to the resilient laminae 22 by dowel-screws 23 which have the double function of positioning and blocking the support 21.

Each support 21 comprises at its upper end a tongue 25 having a slot 26. Under each tongue 25 is mounted, in a suitable race 27 a ball 28 free to rotate in the race.

In correspondence of the tongue 25 of each support 21, there is provided an elastic element 30 connected to the printer frame and having an end portion passing through the slot 26 and cooperating with the ball 28.

A spring 32 is connected between each elastic element 30 and portions 33 of the printer frame.

The springs 32 urge, through elastic elements 30, the thermal head of each support 21 against the thermosensitive paper 11, with a uniform pressure.

In accordance with another aspect of the present invention, the resilient arms **22*a* and 22*b* of each lamina, by their flexion in a direction perpendicular to the printing line and by their little twist around an axis perpendicular to the printing line and parallel to the planar head support 21, allow an uniform contact of all the resistive elements of each head against the thermosensitive medium independently from imperfections in the linearity and cylindricity of the platen 10**.

The slide 18 can be reciprocated along the printing line direction by a crank-connecting rod mechanism 40 of the type described in U.S. Pat. No. 3,951,247, which receives motion from motor shaft 41.

According to a further aspect of the present invention the mechanism 40 comprises a connecting rod 42 having a stiff bar 43 fulcrumed at an end on the crank pin 44 and connected at the opposite end at an extremity of a resilient lamina 45, the other extremity of which is fixed to the base member 20 of the slide 18.

The lamina 45 by bending itself allows the conversion of rotational motion of crank pin 44 into alternative rectilinear motion of slide 18 without use of further hinge between the connecting rod 42 and the base member 20 of the slide 18, so reducing the constructional and wear clearances due to rotational coupling.

During the reciprocated motion of the slide 18, the balls 28 allow displacement of the supports 21 with respect to resilient elements 30.

As described in U.S. Pat. No. 3,951,247, the conductive path of the heads 24 is connected to the driving and control circuit by means of flat cables 50 connected to the lower end of each head 24.

The control circuit for the selective energization of the resistive printing elements of heads 24 to print a desired line of characters during reciprocation of the slide 18, as well as the strobe devices for sensing the position of the slide 18 during its motion and the line feed device for advancing the thermal paper incrementally, can be of the type disclosed in U.S. Pat. No. 3,951,247, having it provided that the driving and control circuit are extended in a known manner for controlling eighty resistive elements.

In FIG. 3 is shown an alternative embodiment of the motion transmission mechanism to the slide 18 suitable for allowing printing on heat sensitive sensitive paper having a second underlying heat copy-sheet.

In order to print on a heat-sensitive material of this last type it is necessary that each resistive element during its energization be temporarily stationary with respect to the paper so that the heat generated by the energized resistive element, passing through the first heat sensitive paper, reaches the underlying heat sensitive copy paper and heats it to a temperature sufficient for causing marking thereof.

It is therefore necessary that the slide 18 advance step-by step along the printing line direction stopping in correspondence of the dot print position for selective energizations of printing elements and displacing between two adjacent dot print positions corresponding to the distance between two adjacent dot of a row of the matrix according to which the characters are printed.

The mechanism of FIG. 3 is designed for advancing the slide 18 of the printer of FIG. 2 (eighty characters per line) in order to print characters according to a matrix of seven row and five column with a character width of 1.45 mm. The distance between two adiacent printing elements of the row being therefore 0.362 mm.

The mechanism of FIG. 3 comprises a cam 70 rotatably mounted on a motor shaft 41 and having a profile extending for 360° including two groups of concentric and diametrically opposite circular arcs 71 and **71*a*, connected by ramps 72 and 72*a***, respectively.

The increment of radius between a circular arc and the adjacent one is 0.362 mm., each circular arc has an angular amplitude of 16°; the profile includes also two circular arcs 72 and **72*a* for radiusing the arc groups 71 and 71*a***, respectively.

Two cam following rollers 80 and 81 cooperate with the profile of the cam 70, the roller 80 is rotatably mounted on a pin 83 of a first arm 88 of an element 84 bridging the cam 70 and fixed to the base member 20 of the slide 18; the roller 81 is rotatably mounted on a pin 85 fixed to a lever 89 fulcrumed on a second arm 86 of the element 84.

A spring 90 is connected between the first arm 88 and the lever 89; the spring 90 urges rollers 80 and 81 in contact with the profile of the cam 70.

The rollers 80 and 81 are positioned diametrically opposite with respect to the profile of the cam 70 in such a way that the distance between rollers 80 and 81 is constant during the clockwise rotation of the cam 70.

During the first clockwise rotation of 180° of the cam 70, starting from the position of FIG. 3, the slide 18 is moved towards the right hand side of the printing line, through six incremental displacements of 0,362 mm during each of which the rollers 80 and 81 cooperate with ramps 72 and 71 of the cam 70; such displacements are temporarily spaced by five stops in correspondance with the cooperation of rollers 80 and 81 with circular arcs 71 and **71*a*** during which the control circuit selectively energizes each of the eighty sensitive printing elements for printing all the five dots of a row of the matrix for all the eighty dot-matrix characters of the line of print.

During a successive rotation of 180° of the cam 70, the slide 18 is moved from the right hand side of the printing line towards the left hand slide, again through six incremental displacements for a total displacement of 2,172 mm during which another row of dots for all the eighty characters of the line is printed.

The mounting of the row of printing elements parallel to the printing operation according to the invention should not be considered limited either to serial-parallel printers or to the thermal non impact printing method;

such a mounting being usefull also in parallel printers using various non impact-printing methods with a long row of printing elements coated on a planar substrate.

Moreover, while the preferred embodiment is a printer for dot-matrix alphanumeric characters it should be clear that the same printer according to the invention can be used, by modifying in a known manner the control circuit, for plotting diagrams by a succession of dots.

It is to be understood that various modifications to the embodiments described can be made without departing from the spirit and the scope of the invention as claimed by the following claims.

What I claim is:

1. Non impact matrix printer for printing dot-composed graphic information on a recording medium comprising:

a printer frame, a platen mounted on said frame, for supporting the recording medium along a printing line direction, a base member extending along and movable parallel to said printing line direction, a plurality of printing heads, each including a row of regularly spaced dot size printing elements supported on a planar surface of the head and mounted on said base member, adjacent each other with the rows aligned to form a single long row of equally spaced printing elements parallel to the printing line direction, mounting means fixed to said base member, for independently supporting each of said heads and, a reciprocating mechanism including a cam with a profile divided into a first and a second symmetrical part, wherein each of said parts extends through 180° and includes a staircase like portion connected to a constant portion.

2. Non impact dot matrix printer according to claim 1, in which the base member is movable on said printer frame parallel to the printing line a mechanism being provided for reciprocating said base member along the line of print direction, synchronously with said advancing means, said mounting means including at least a pressure element slidably engaging the corresponding printing head and pivotally mounted on said printer frame and a compression spring mounted between said printer frame and said pressure element for urging the planar surface of said printing head toward said platen.

3. Non impact dot matrix printer according to claim 2, in which said mounting means includes a pressure element fixed to said printer frame and each head comprises a ball bearing on a surface opposite to the planar surface, each pressure element cooperating with the corresponding ball during reciprocating of the base member.

4. Non impact matrix printer according to claim 1, further comprising a pair of cam following rollers cooperating with the cam profile at points angularly spaced by 180; in which one of the cam following rollers being rotatably mounted on a support fixedly connected to the base member, while the other cam following roller is rotatably mounted on a lever fulcrumed on said support a spring being connected between the lever and the support for urging said rollers into contact with the cam profile.

5. Non impact matrix printer for printing dot-composed graphic information on a recording medium comprising:

a printer frame, a platen mounted on said frame, for supporting the recording medium along a printing line direction, a base member extending along and movable parallel to said printing line direction, a plurality of printing heads, each including a row of regularly spaced dot size printing elements supported on a planar surface of the head and mounted on said base member, adjacent each other with the rows aligned to form a single long row of equally spaced printing elements parallel to the printing line direction, mounting means fixed to said base member, for independently supporting each of said heads and, a reciprocating mechanism including a cam with a profile divided into a first and a second symmetrical part, wherein each of said parts extends through 180° and includes a staircase lilke portion connected to a constant portion, wherein each step of said staircase includes a circular arc, each circular arc of said first part having the same radius as the corresponding arc of said second part symmetrically spaced with respect to said constant portion, and the difference between the radiuses of two adjacent arcs being constant, whereby the distance between two points of the cam profile angularly spaced by 180° is constant.

* * * * *